US009737752B2

(12) United States Patent
Walter et al.

(10) Patent No.: US 9,737,752 B2
(45) Date of Patent: Aug. 22, 2017

(54) ADJUSTABLE TRAINING APPARATUS

(71) Applicant: ELEVEN, LLC, Boston, MA (US)

(72) Inventors: Glen V. Walter, Boxford, MA (US); Paul R. Vincent, Sr., East Falmouth, MA (US); Michael Thomas McDuffee, Gloucester, MA (US); Ryan Joseph Donovan, Weymouth, MA (US)

( * ) Notice: Subject to any disclaimer, the term of this patent is extended or adjusted under 35 U.S.C. 154(b) by 0 days.

(21) Appl. No.: 14/784,769

(22) PCT Filed: May 15, 2014

(86) PCT No.: PCT/US2014/038232

§ 371 (c)(1),
(2) Date: Oct. 15, 2015

(87) PCT Pub. No.: WO2014/189767

PCT Pub. Date: Nov. 27, 2014

(65) Prior Publication Data

US 2016/0074699 A1 Mar. 17, 2016

Related U.S. Application Data

(60) Provisional application No. 61/825,800, filed on May 21, 2013.

(51) Int. Cl.

| | |
|---|---|
| ***A63B 21/04*** | (2006.01) |
| ***A63B 21/00*** | (2006.01) |
| ***A63B 21/02*** | (2006.01) |
| ***A63B 23/035*** | (2006.01) |
| ***A63B 23/04*** | (2006.01) |
| ***A63B 23/12*** | (2006.01) |

(52) U.S. Cl.
CPC .... *A63B 21/4025* (2015.10); *A63B 21/00061* (2013.01); *A63B 21/00072* (2013.01);
(Continued)

(58) Field of Classification Search
CPC ..... A63B 21/00185; A63B 21/4001; A63B 21/4005; A63B 21/4007;
(Continued)

(56) References Cited

U.S. PATENT DOCUMENTS 4,961,573 A * 10/1990 Wehrell ..... A63B 21/0552 482/124
5,358,461 A * 10/1994 Bailey, Jr. ..... A63B 21/0053 290/1 R
(Continued)

FOREIGN PATENT DOCUMENTS

WO 2012/165945 A1 12/2012

OTHER PUBLICATIONS

Notification of Transmittal of the International Search Report and the Written Opinion of the International Searching Authority from corresponding PCT/US2014/038232 dated Oct. 8, 2014.

*Primary Examiner* — Gregory Winter
(74) *Attorney, Agent, or Firm* — Lando & Anastasi, LLP

(57) ABSTRACT

An adjustable training apparatus includes a harness that is worn over an upper torso of a person training, and two tensioning devices that are secured to the harness. Each tensioning device includes a cord that extends from the device, with an outer end of the cord being configured to be secured to a body part of the person training. A method of conducting anaerobic resistance training is further disclosed.

17 Claims, 11 Drawing Sheets

(52) U.S. Cl.
CPC ..... *A63B 21/00185* (2013.01); *A63B 21/025* (2013.01); *A63B 21/0442* (2013.01); *A63B 21/151* (2013.01); *A63B 21/4005* (2015.10); *A63B 21/4007* (2015.10); *A63B 21/4009* (2015.10); *A63B 21/4011* (2015.10); *A63B 21/4013* (2015.10); *A63B 21/4015* (2015.10); *A63B 21/4027* (2015.10); *A63B 21/4043* (2015.10); *A63B 23/0355* (2013.01); *A63B 23/03541* (2013.01); *A63B 23/04* (2013.01); *A63B 23/12* (2013.01); *A63B 2225/09* (2013.01)

(58) Field of Classification Search
CPC ..... A63B 21/4009–21/4021; A63B 21/4025; A63B 21/0442; A63B 21/151; A63B 21/153; A63B 21/156; A63B 2210/58
USPC ..... 182/3, 231, 232, 233, 234, 235, 5, 6
See application file for complete search history.

(56) References Cited

U.S. PATENT DOCUMENTS 5,792,034 A * 8/1998 Kozlovsky ..... A63B 21/0004 482/124
5,813,955 A * 9/1998 Gutkowski ..... A63B 21/0004 482/121
6,652,431 B1 11/2003 Mattox
6,659,921 B2 * 12/2003 Vernon ..... A63B 21/4025 482/114
7,563,212 B2 * 7/2009 Smith ..... A63B 21/025 482/124
8,833,310 B2 * 9/2014 Konigsberg ..... A01K 27/00 119/770
8,939,874 B2 * 1/2015 Mizrachy ..... A63B 21/4007 482/124
2004/0053755 A1 * 3/2004 Wilkinson ..... A63B 21/153 482/124
2005/0282689 A1 12/2005 Weinstein
2006/0040805 A1 2/2006 Wilkinson
2007/0083975 A1 4/2007 Senegal
2007/0219074 A1 9/2007 Pride
2009/0062087 A1 3/2009 Poppinga
2009/0093350 A1 * 4/2009 Jahns ..... A63B 21/0004 482/110
2009/0258768 A1 10/2009 Clarke
2009/0305827 A1 * 12/2009 Webb ..... A63B 69/0002 473/458
2012/0220436 A1 8/2012 Zoltak
2012/0302412 A1 * 11/2012 Nail ..... A63B 21/0442 482/129

* cited by examiner

ADJUSTABLE TRAINING APPARATUS

CROSS-REFERENCE TO RELATED APPLICATIONS

This application is a U.S. National Stage Application under 35 U.S.C. §371 of International Application No. PCT/US2014/038232, filed May 15, 2014, entitled ADJUSTABLE TRAINING APPARATUS, which claims priority under 35 U.S.C. §119(e) to U.S. Provisional Patent Application Ser. No. 61/825,800, filed May 21, 2013, entitled ADJUSTABLE TRAINING APPARATUS, both of which are incorporated herein by reference in their entirety.

BACKGROUND OF THE DISCLOSURE

1. Field of Disclosure

The present disclosure relates generally to exercise training aides, and more particularly to an adjustable training apparatus that can be worn during physical activities beyond repetitive training exercises.

2. Discussion of Related Art

Exercise training aides, especially apparatus directed to resistance training, are well known in the art. Strength training involving resistance exercise is useful for building strength, anaerobic endurance, and size of skeletal muscles. There are many types of resistance training equipment, including use of resistant bands. Resistance bands and resistance tubes provide athletes with a variety of different levels of resistance by shortening or lengthening the band or by providing bands having varying thicknesses (resistances). A person training with such resistant bands can reposition a single band in a variety of ways in order to perform different exercises. However, while resistance bands are suited for performing particular exercises, they are somewhat insufficient to use when performing anaerobic exercises, such as running or skating.

SUMMARY OF DISCLOSURE

One aspect of the present disclosure is directed to an adjustable training apparatus comprising a harness that is worn over an upper torso of a person training, and two tensioning devices that are secured to the harness. Each tensioning device includes a cord that extends from the device, with an outer end of the cord being configured to be secured to a body part of the person training.

Embodiments of the adjustable training apparatus further may include, for each tensioning device, a connection assembly configured to releasably secure an end of the cord to the body part of the person training. The connection assembly may include a foot harness having a body portion and a strap having hook and loop fastener material that is secured to the body portion. The strap may be configured to secure the body portion to the body part of the person training. The connection assembly further may include a first connector secured to the end of the cord and a second connector secured to the foot harness. The first connector and the second connector may be releasably coupled to one another. The first connector may include a female element and the second connector includes a male element. The strap may be configured to be secured to a running shoe. The harness may include a strip of material configured to be worn over shoulders of the person training and a plurality of straps coupled to the strip of material, the plurality of straps being configured to be cinched on the torso of the person training. The harness further may include a collar portion integrally formed with the strip of material, the collar portion being configured to engage a neck of the person training. The harness further may include a first shoulder portion that extends down from the collar portion on one shoulder of the person training and a second shoulder portion that extends down from the collar on another shoulder of the person training. The plurality of straps may include a first vertical strap that extends down from the first shoulder portion of the strip of material, a second vertical strap that extends down from the second shoulder portion of the strip of material, and a third vertical strap that extends down from the collar portion of the strip of material. The plurality straps further may include a horizontal strap that is secured to the first vertical strap, the second vertical strap and the third vertical strap. The horizontal strap may extend crosswise with respect to the vertical straps. A first tensioning device may be releasably secured to the first vertical strap and the horizontal strap by a first disc and a second tensioning device is releasably secured to the second vertical strap and the horizontal strap by a second disc. The tensioning devices may be interchanged to increase or decrease a tension of the cord. The cords of the tensioning devices may extend along respective sides of the person training when wearing the adjustable training apparatus. In one embodiment, each tensioning device may include a housing, a retractable spool assembly having the cord that extends from and retracts into the housing, and a brake to releasably clamp the cord at a desired length. In another embodiment, each tensioning device may include a generally circular body and a wheel slidably movable in the body between an a first position in which the wheel is free to rotate and a second position in which the wheel is locked to maintain the cord wrapped around the wheel in a locked position.

Another aspect of the present disclosure is directed to a method of conducting anaerobic resistance training. In one embodiment, the method comprises: securing a harness to an upper torso of a person training; extending cords of two tensioning devices that are secured to the harness to a body part of the person training; securing the cords of the two tensioning devices to the body part of the person training; and performing an anaerobic activity.

Embodiments of the method further may include extending the cords of the two tensioning devices along respective sides of the person training when wearing the adjustable training apparatus. Securing the harness to the upper torso of the person training may include placing a strip of material of the harness about the neck and shoulders of the person training and cinching the strap assemblies of the harness. Securing the cords of the two tensioning devices to a body part of the person training may be achieved by a connection assembly including a first connector secured to the end of the cord and a second connector secured to the body part of the person training. The first connector and the second connector may be releasably coupled to one another.

BRIEF DESCRIPTION OF THE DRAWINGS

Various aspects of at least one embodiment are discussed below with reference to the accompanying figures, which are not intended to be drawn to scale. Where technical features in the figures, detailed description or any claim are followed by references signs, the reference signs have been included for the sole purpose of increasing the intelligibility of the figures, detailed description, and claims. Accordingly, neither the reference signs nor their absence are intended to have any limiting effect on the scope of any claim elements. In the figures, each identical or nearly identical component that is illustrated in various figures is represented by a like numeral. For purposes of clarity, not every component may be labeled in every figure. The figures are provided for the purposes of illustration and explanation and are not intended as a definition of the limits of the disclosure. In the figures:

DETAILED DESCRIPTION

The present disclosure is directed to an adjustable training apparatus or system that is worn during training. The training apparatus includes a harness that is worn over an upper torso of the person training. In one embodiment, the harness is similar to a vest, and includes two tensioning devices that are snapped onto the harness at a front of the harness. In another embodiment, the adjustable training apparatus can be configured to position the two tensioning devices at a back of the harness. Each tensioning device includes a tensioned cord that extends from the device, with an outer end of the cord being secured to a body part, such as the wearer's foot or ankle. In one embodiment, the end of the cord may be secured to a connection assembly to releasably secure the cord to the wearer's foot or shoe. The connection assembly includes a body portion and a strap or multiple straps, each having hook and loop fastener material to releasably secure the body portion to the wearer's foot or shoe. The connection assembly further includes a connection element secured to the cord and a mating connection element attached to the body portion. The cord, when secured to the wearer's body part, provides tension and resistance to the body part when training with the training apparatus.

During training, the training apparatus enhances the wearer's technique, strength, endurance, and agility. The training apparatus enhances technique by enabling correct form, posture, and mechanics. The training apparatus enables users to isolate muscles while promoting proper technique in the intended environment. The adjustable training apparatus is adjustable, easy to use, easy to control, comfortable, and durable.

Figure 1:
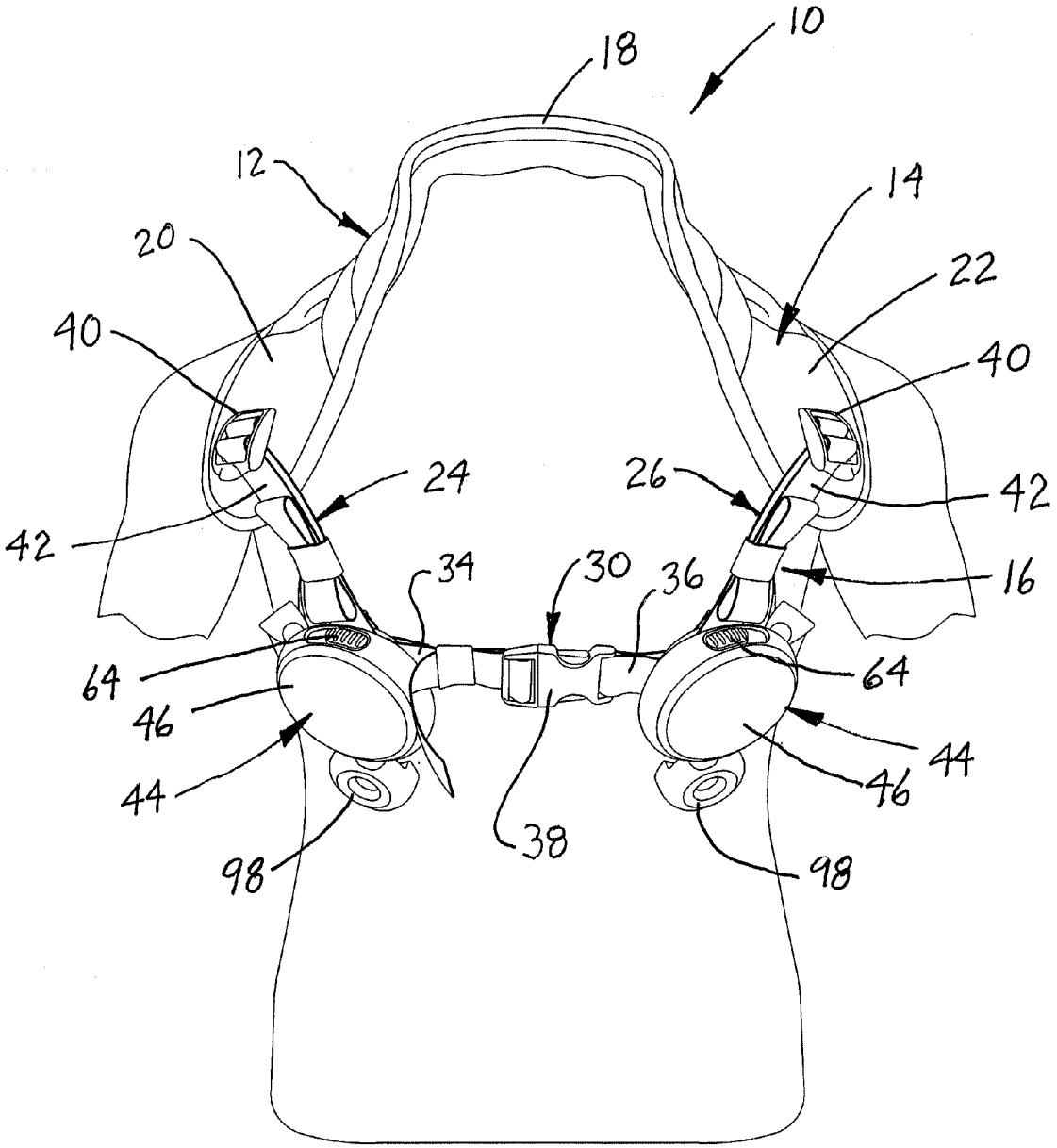
FIG. 1 is a front view of a harness of an adjustable training apparatus.
Figure 2:
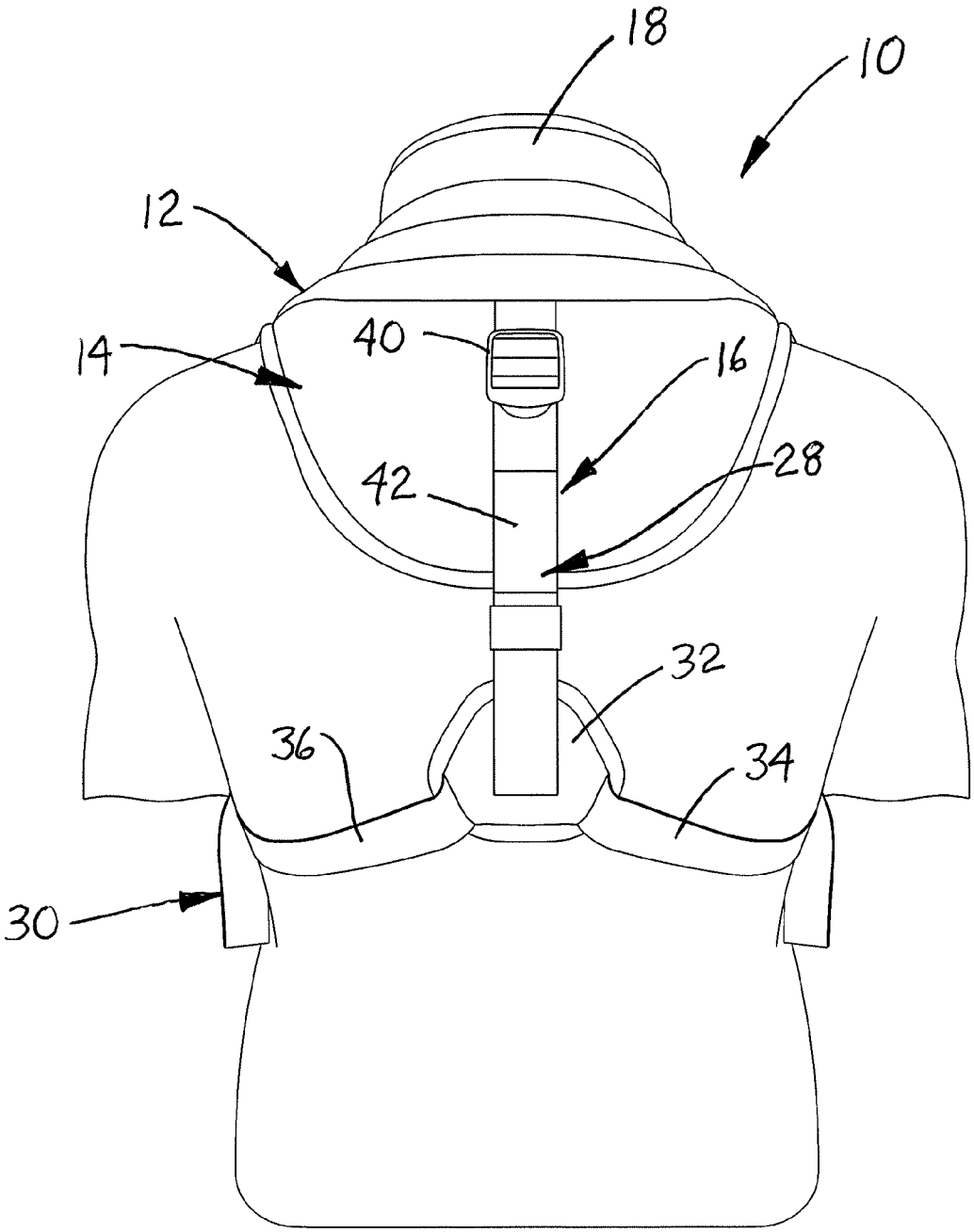
FIG. 2 is a back view of the harness.
Figure 3:
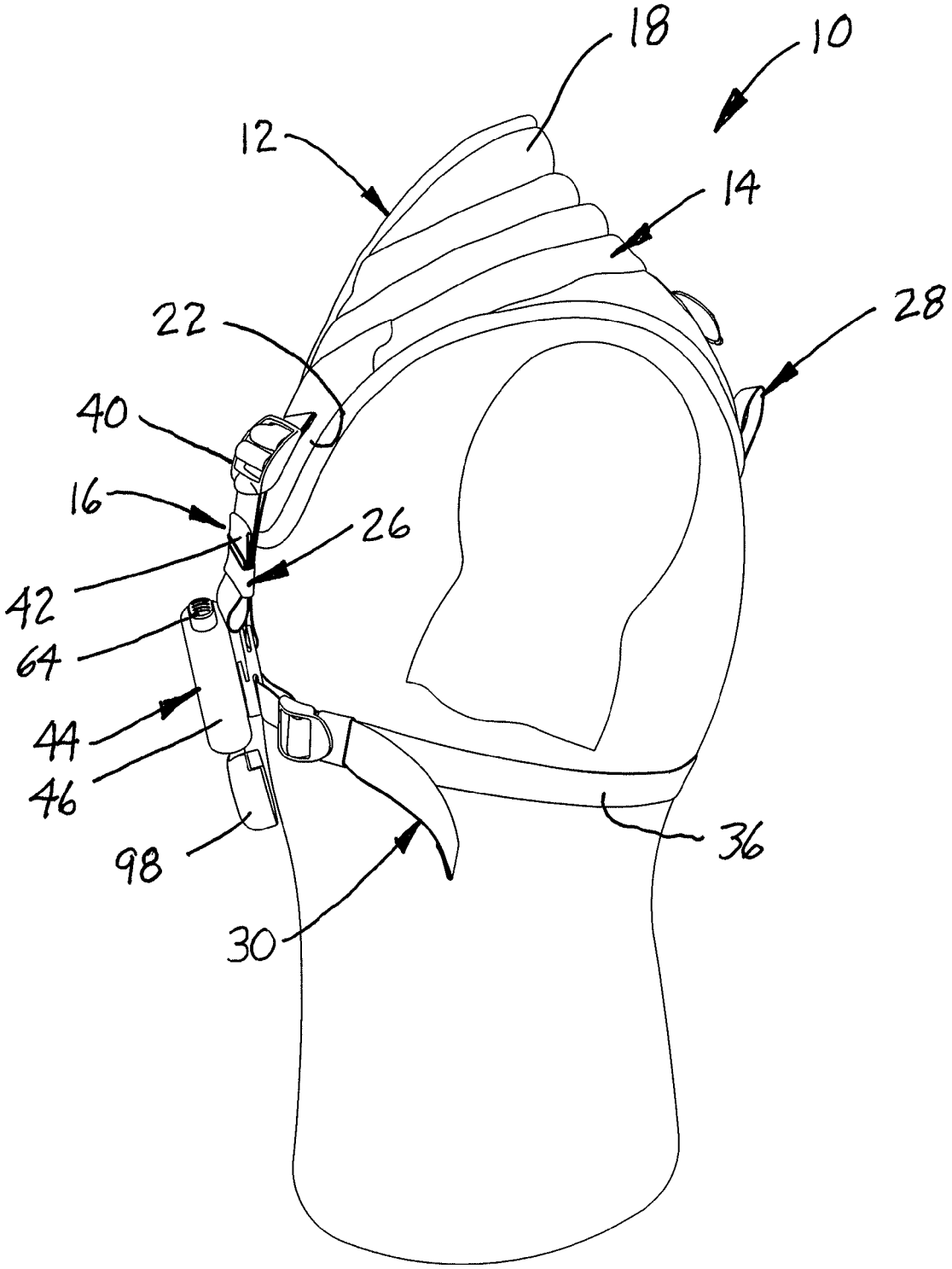
FIG. 3 is a side view of the harness.

Referring now to the drawings, and more particularly to FIGS. 1-3, an adjustable training is generally indicated at 10. As shown, the adjustable training apparatus 10 includes a harness generally indicated at 12 that is worn over an upper torso of a person training with the adjustable training apparatus. In one embodiment, the harness 12 includes a strip of material generally indicated at 14 that is configured to be worn over shoulders and around the neck of the person training. In a preferred embodiment, the strip of material 14 is fabricated from flexible material and may include a cushion layer so that the harness is comfortable to the person training when worn. The harness 12 further includes several straps generally indicated at 16 that are secured to the strip of material 14 by cinching the straps on the torso of the person training. Although a harness 12 having a strip of material 14 and several straps 16 is shown and described herein, the harness may embody any number of configurations. For example, the harness 12 may include a vest made from fabric material that is worn on the upper torso of the person training.

In the shown embodiment, the strip of material 14 includes a collar portion 18 that is configured to engage a neck of the person training, a first shoulder portion 20 that extends down from one side of the collar portion on one shoulder of the person training, and a second shoulder portion 22 that extends down from the other side of the collar portion on the other shoulder of the person training. As shown, the strip of material 14, including the collar and shoulder portions 18, 20, 22, is particularly designed to be worn over the shoulders of the person training in a comfortable manner. The several straps 16 include a first vertical strap assembly generally indicated at 24 that extends down from the first shoulder portion 20 of the strip of material 14, a second vertical strap assembly generally indicated at 26 that extends down from the second shoulder portion 22 of the strip of material, and a third vertical strap assembly generally indicated at 28 that extends down from the collar portion 18 of the strip of material (FIG. 2). As will be described in greater detail below, the lengths of the vertical strap assemblies 24, 26, 28 may be adjusted to accommodate the size of the person training.

The several straps 16 further include a horizontal strap assembly 30 that is secured to lower ends of the first vertical strap assembly 24, the second vertical strap assembly 26 and the third vertical strap assembly 28, with the horizontal strap extending crosswise with respect to the vertical strap assemblies. In one embodiment, the horizontal strap assembly 30 includes a small piece of flexible material 32 that is positioned at a central location on the upper back of the person training (FIG. 2). The horizontal strap assembly 30 further includes two strap portions 34, 36 extending laterally from the small piece of flexible material 32, one for each side of the person training. The horizontal strap assembly 30 further includes a snap fastener 38 having a male portion secured to strap portion 34 and a female portion secured to strap portion 36. The arrangement is such that the horizontal strap assembly is configured to cinch around the torso of the person training by pulling a free end of the strap portion 34.

In the shown embodiment, each vertical strap assembly 24, 26, 28 includes a buckle 40 that is secured to the strip of material 14 (e.g., directly onto the strip or material or by a relatively short strap) and a strap portion 42 that is secured to the horizontal strap assembly 30. The lower ends of the strap portions 42 of the first and second vertical strap assemblies 24, 26 are suitably secured by stitching or another element, such as a buckle, to respective strap portions 34, 36 of the horizontal strap assembly 30. Similarly, the lower end of the strap portion 42 of the third vertical strap assembly 28 is secured to the small piece of flexible material 32 by any suitable method, such as stitching. The result is that the harness 12 is fully adjustable by adjusting the lengths of the first, second and third vertical strap assemblies 24, 26, 28 and the length of the horizontal strap assembly 30 to accommodate the size and body shape of the person training. When worn, it is desirable that the harness 12 fits the person training in a snug manner, but not too tight so as to inhibit the flexibility of the person training while exercising. Also, it is desirable that the harness 12 be worn around the upper torso of the person training so that the horizontal strap assembly 30 is position just below the pectoral muscles.

Figure 4:
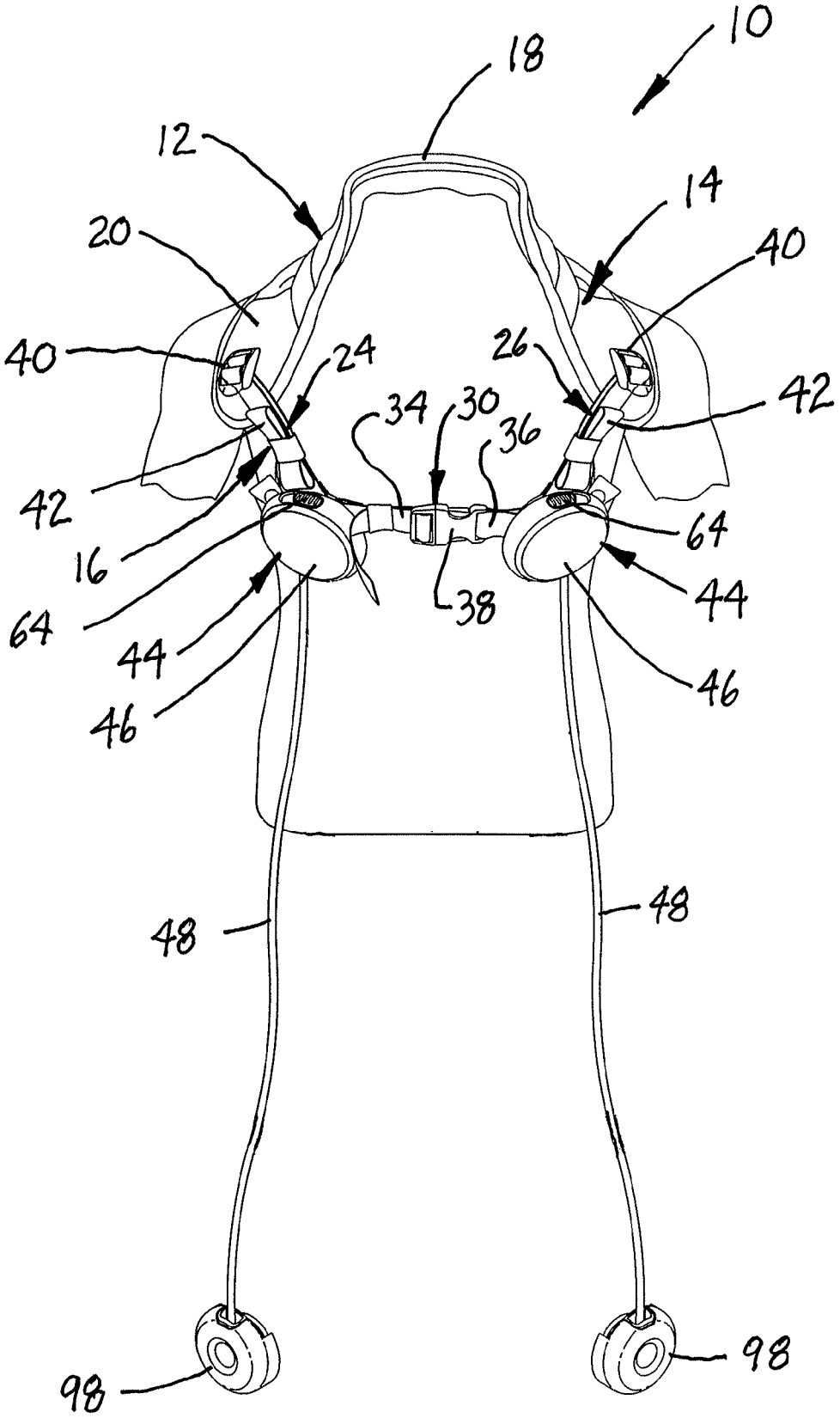
FIG. 4 is a front view of the harness showing cords of tensioning devices in an extended position.

Referring additionally to FIG. 4, the adjustable training apparatus 10 further includes two tensioning devices, each generally indicated at 44, that are secured to the harness 12. In one embodiment, each tensioning device 44 includes a housing 46 that is releasably secured to the harness 12 and a cord 48 that extends from and retracts back into the housing. As shown, the cord 48 of each tensioning device 44 has an outer end that configured to be secured to a body part of the person training in the manner described below. In one embodiment, the cord 48 is a shock cord, which is an elastic cord having a solid elastomeric core made from extruded rubber (e.g., ethylene propylene diene monomer ("EPDM")), with a polyester sheath covering the core. It should be noted that the cord 48 can be fabricated from any number of materials suitable for expanding and retracting in a lengthwise direction. In a particular embodiment, the cords 48 of the tensioning devices 44 are of sufficient length so that they can extend toward the lower extremities, e.g., the feet, of the person training.

Figure 5A:
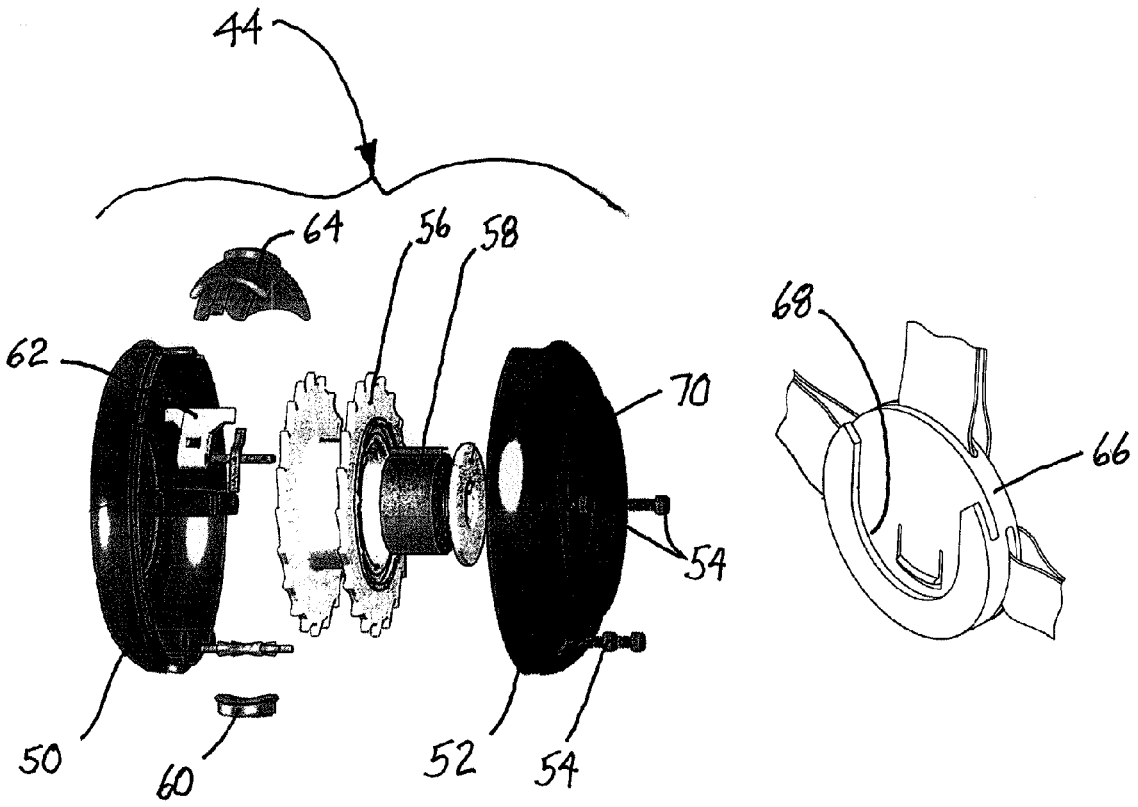
FIG. 5A is an exploded perspective view of one of the tensioning devices shown in FIG. 4.

Referring to FIG. 5A, in one embodiment, the housing 46 of the tensioning device 44 includes a front shell 50 and a back shell 52, which are releasably secured to one another by several screw fasteners each indicated at 54 to hold the working components of the tensioning device within the housing. The tensioning device 44 includes a spool assembly having a spool 56 and a power spring 58 to bias the spool when the cord 48 is wrapped around the spool. The arrangement is such that the cord 48 extends through a mouthpiece 60, which is held in place by the front shell 50 and the back shell 52 when secured to one another. The tensioning device 44 further includes a brake 62 that is movable by a slidable button 64 to lock the spool 56 in place when the cord 48 is at a desired length. As shown, the spool 56, power spring 58, brake 62 and the other components of the tensioning device 44 are disposed within the housing 46, with the cord 48 being configured to extend from and retract back into the housing. The brake 62 is configured to secure the cord 48 at a desired length when the button 64 is slid to a locked position and to enable the cord to be retracted into the housing by the power spring 58 when the button is slid to an unlocked position. In the shown embodiments, the cord 48 of each tensioning device 44 is secured to an object to prevent the cord from being fully retracted into the housing 46 under the bias provided by the power spring 58.

The back shell 52 of the housing 46 of each tensioning device 44 is configured to be releasably secured to a disc 66 that is secured to one of the vertical strap assemblies 24, 26 and the horizontal strap assembly 30. In other embodiments, the discs 66 may be releasably secured to the shoulder portions 20, 22 of the strip of material 14. Each disc 66 includes a slot 68 formed therein to releasably receive a portion 70 of the back shell 52 of the housing 46 that is designed to fit within the slot in a snap-fit manner. The arrangement is such that the tensioning devices 44 can be interchanged to increase or decrease a tension of the cord 48. Thus, a person desiring more resistance can select tensioning devices having cords with stronger elasticity.

Figure 5B:
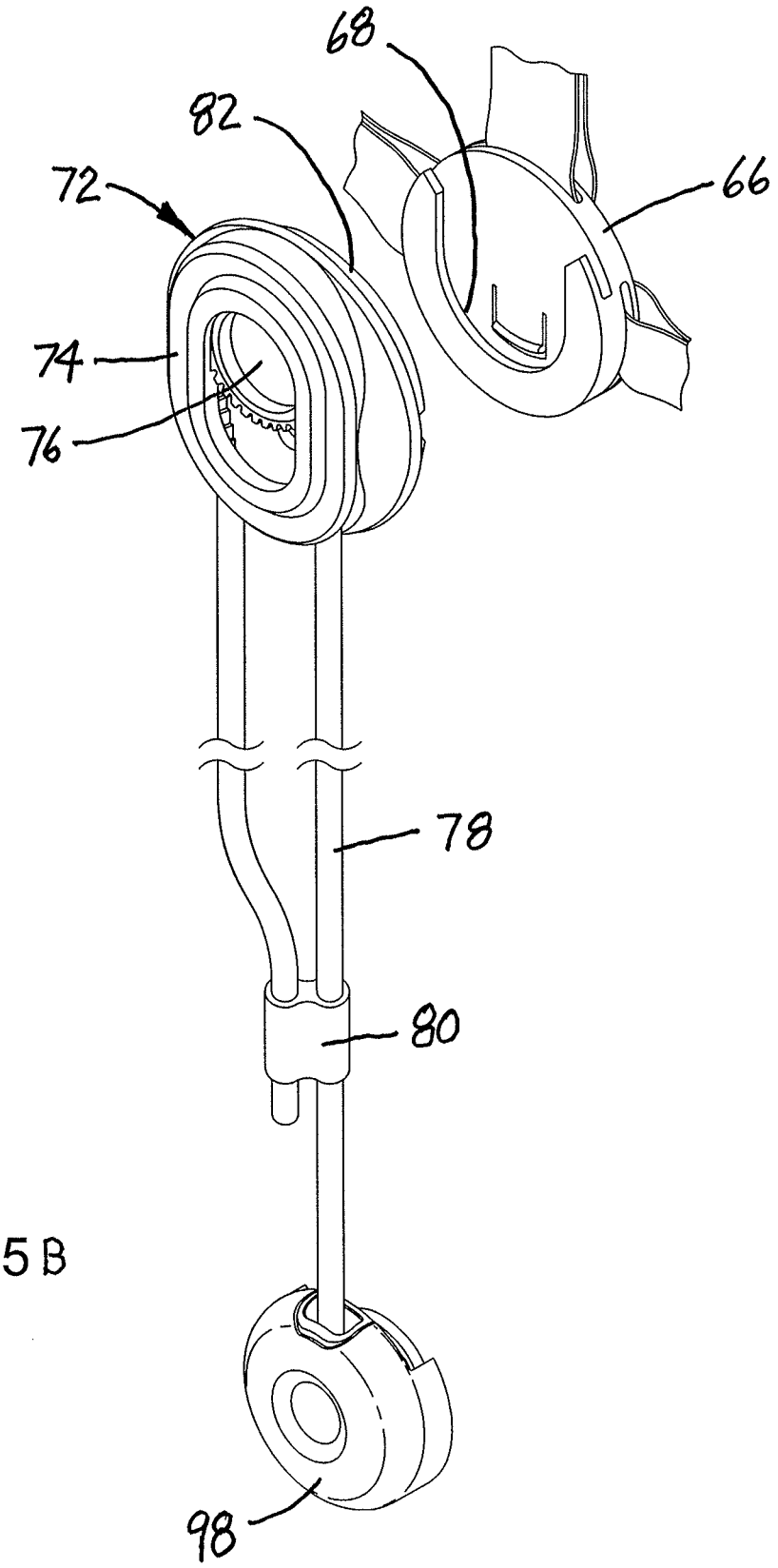
FIG. 5B is an exploded perspective view of a tensioning device of another embodiment.
Figure 6:
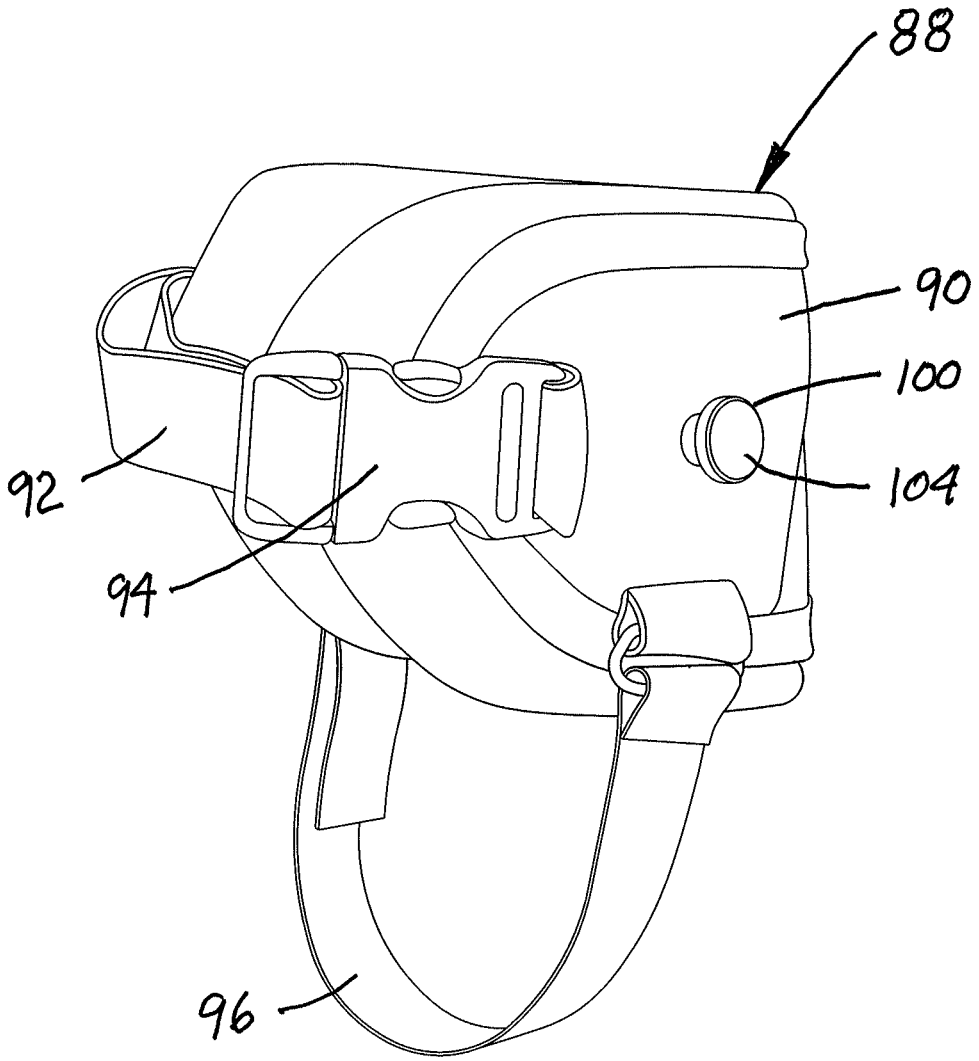
FIG. 6 is a perspective view of a portion of a connector assembly of the adjustable training apparatus that is configured to be secured to a shoe of a person training.

FIG. 5B illustrates a tensioning device generally indicated at 72 of another embodiment. As shown, the tensioning device 72 includes a generally circular body 74 and a wheel 76 slidably movable in the body between an upper position in which the wheel is free to rotate and a lower position in which the wheel is locked to maintain a cord 78 wrapped around the wheel in a locked position. When the wheel 76 is in the upper position, the cord 78 can be rotated around the wheel to lengthen and shorten the cord as desired by element 80. As with tensioning device 44, the body 74 of the tensioning device 72 is configured to be releasably secured to the disc 66 that is secured to one of the vertical strap assemblies 24, 26 and the horizontal strap assembly 30. The body includes a portion 82 that is designed to fit within the slot 68 of the disc 66 in a snap-fit manner.

Figure 7:
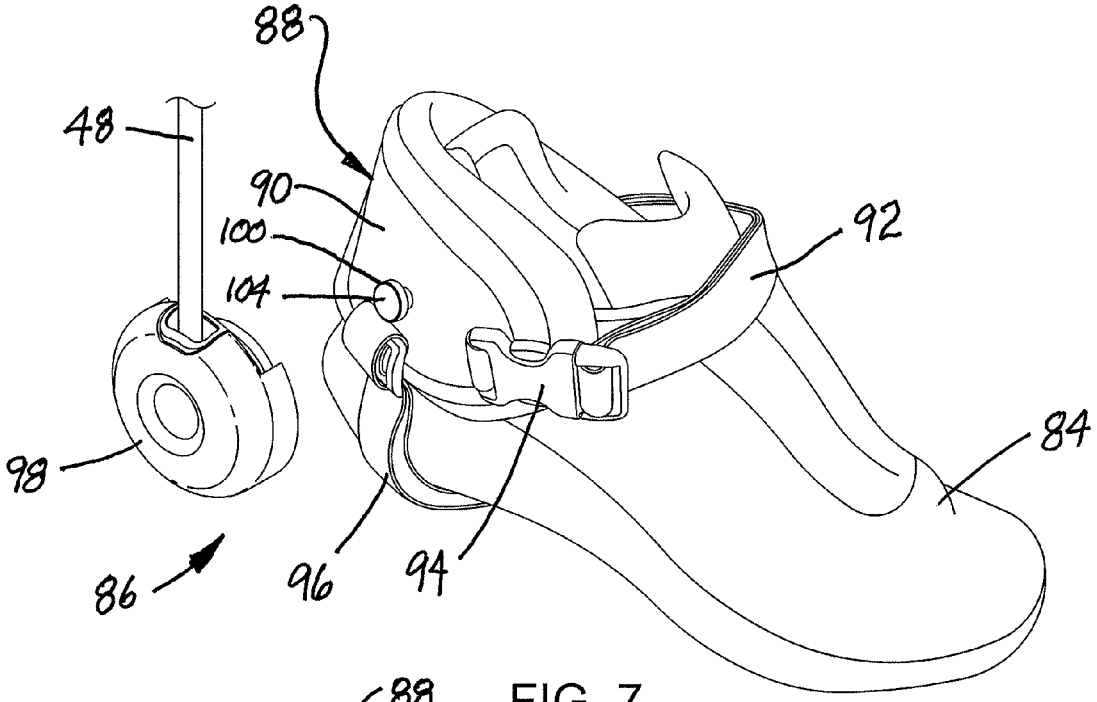
FIG. 7 is a perspective view of the connector assembly in a disassembled condition.
Figure 8:
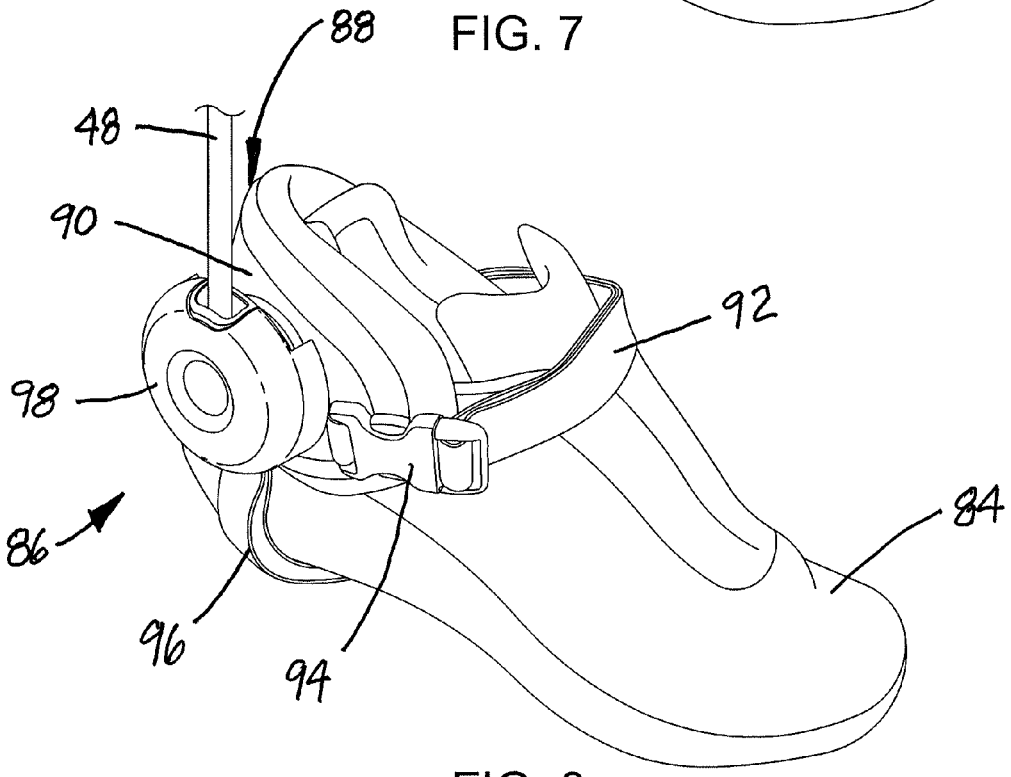
FIG. 8 is a perspective view of the connector assembly in an assembled condition.

Referring back to FIG. 4, and additionally to FIGS. 6-10, the adjustable training apparatus 10 further includes a connection assembly to releasably secure an end of each cord 48 to a body part of the person training, e.g., a shoe 84 worn on a foot of the person training. Referring particular to FIGS. 7 and 8, a connection assembly is generally indicated at 86. As mentioned above, a component of the connection assembly 86 prevents the cord 48 from being fully retracted back into the housing 46 of the tensioning device 44. In one embodiment, the connection assembly 86 includes a foot harness generally indicated at 88 that is configured to be secured to the foot (e.g., the shoe 84) of the person training. It should be noted that the foot harness 88 can be configured to be secured to other body parts, such as the ankles of the person training. As shown in FIGS. 7 and 8, the foot harness 88 of the connection assembly 86 is specifically designed to be secured to a person's shoe. In another embodiment, the foot harness 88 can be secured to a person's skate.

In one embodiment, the foot harness 88 of the connection assembly 86 includes a flexible body portion 90 that engages the back portion of the shoe 84 (or skate). As with the strip of material 14 of the harness 12, the body portion 90 of the connection element 86 is made from flexible material having a cushion layer so that the connection element is comfortable when worn. The foot harness 88 of the connection assembly further includes a strap 92 having hook and loop fastener material to secure the body portion 90 to the person's shoe. One end of the strap 92 is secured to the body portion 90 of the connection element 86 and the other end of the strap is secured to the body portion by a snap fastener 94. As shown, the strap 92 can be cinched and secured in place by the hook and loop fastener material to secure the foot harness 88 to the body part of the person training. Another strap 96 can be provided to secure the body portion 90 to the person's shoe 84, with this additional strap extending underneath the shoe. With a skate, this additional strap 96 can be threaded through a traditional opening provided above the blade of the skate when securing the connection element to the body part.

Figure 9:
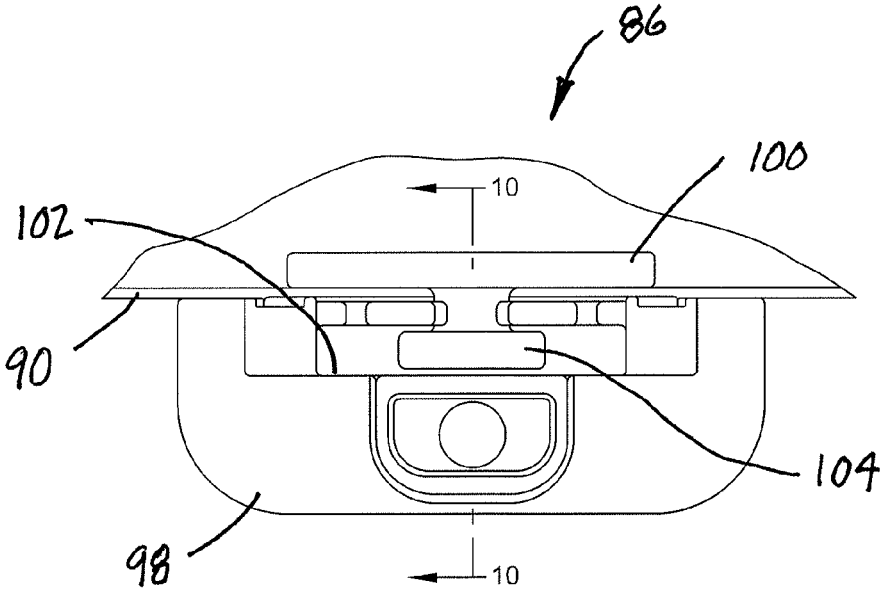
FIG. 9 is a side elevational view of connector elements of the connector assembly in an assembled condition.
Figure 10:
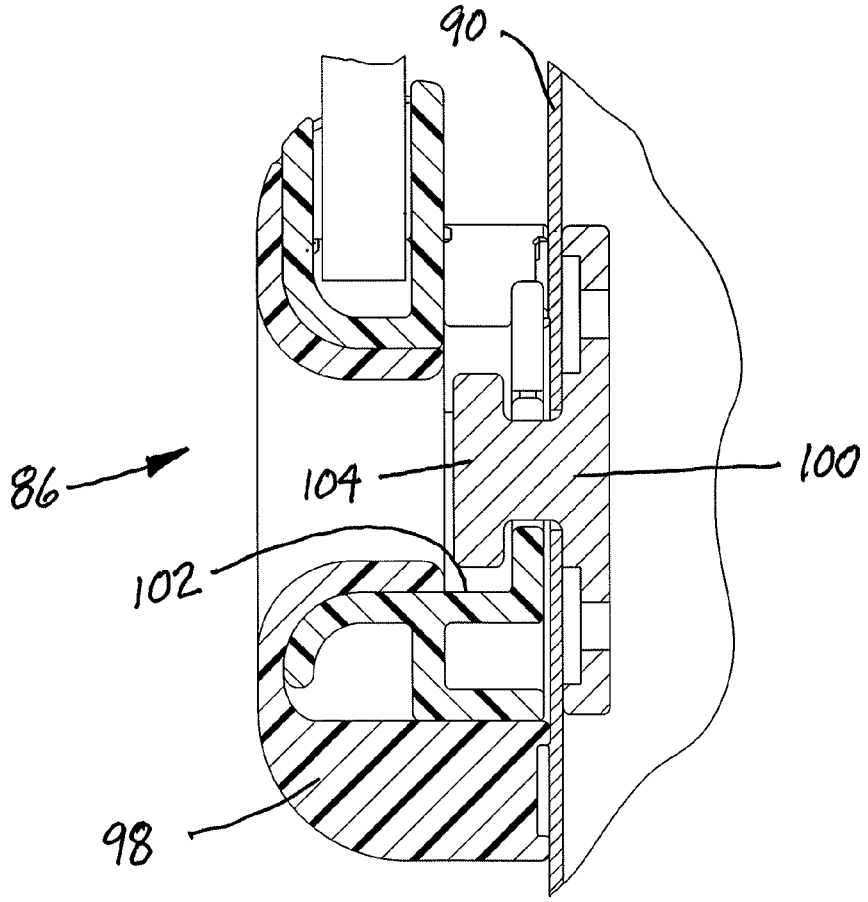
FIG. 10 is a cross-sectional view taken along line 10-10 in FIG. 9.

Referring particularly to FIGS. 7-10, the connection assembly further includes a first connector 98 secured to the end of the cord 48 and a second connector 100 secured to the body portion 90 of the foot harness 88. As shown in FIG. 7, the first connector 98 can be used to extend the cord 48 to a length sufficient to reach the foot of the person training. The first connector 98 is positioned proximate to the second connector 100 prior to assembling these parts together. As shown in FIG. 8, the first connector 98 and the second connector 100 are releasably assembled to one another to secure the end of the cord 48 to the foot of the person training. In one embodiment, the first connector 98 includes a female part 102 and the second connector 100 includes a male part 104. Referring specifically to FIGS. 9 and 10, the male part 104 is received within the female part 102 in a snap-fit manner to secure the first and second connectors 98, 100 to one another. Once secured, the adjustable training apparatus 10 provides a desired amount of resistance to the core and lower body of the person training during exercise.

Figure 11:
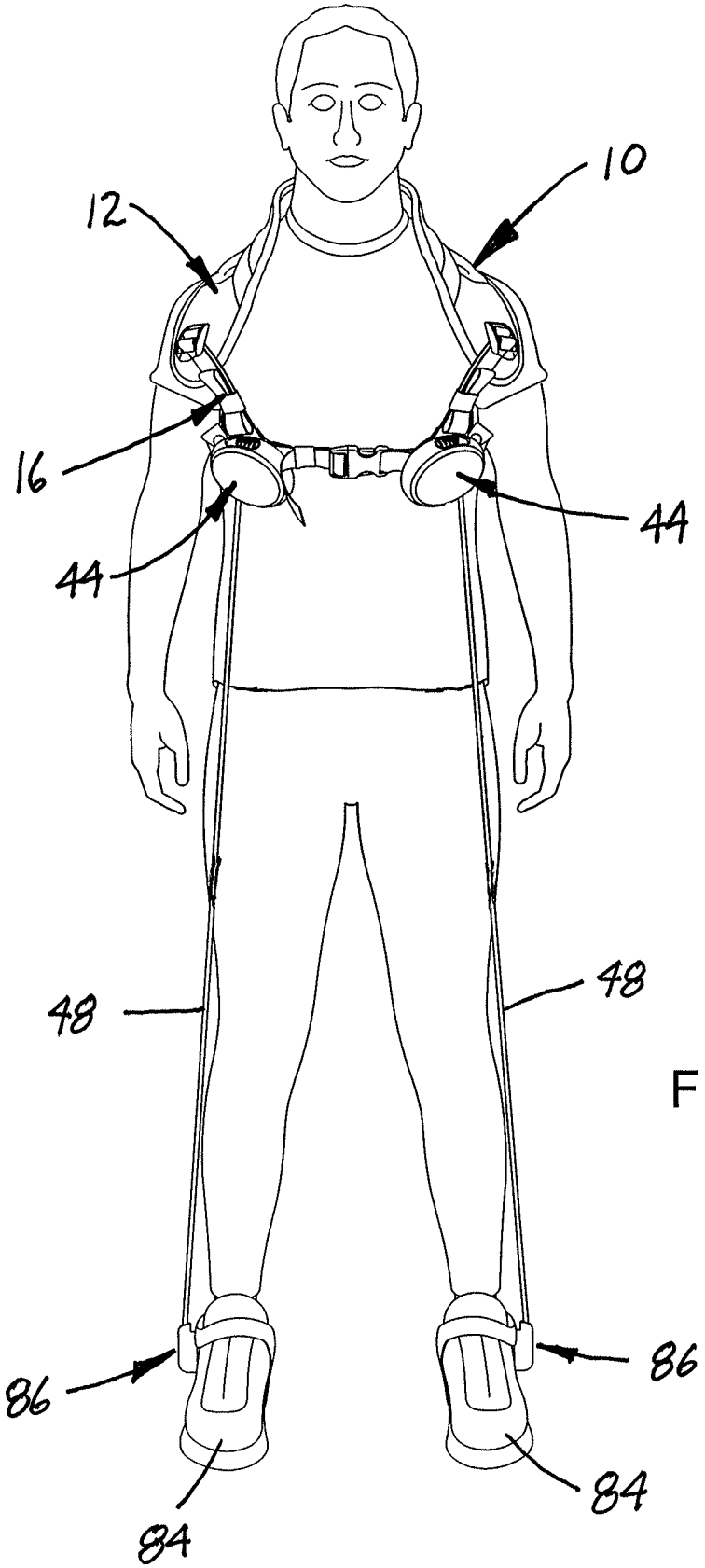
FIG. 11 is a front elevational view of the adjustable training apparatus that is worn by a user.

Referring to FIG. 11, the completed adjustable training apparatus 10 is shown being worn by a person training. As shown, the cords 48 of the tensioning devices 44 extend along respective sides of the person training when wearing the adjustable training apparatus 10. A method of conducting anaerobic resistance training may include securing the harness 12 to an upper torso of a person training by placing the strip of material 14 about the neck and shoulders of the person training and cinching the vertical and horizontal strap assemblies 24, 26, 28, 30. Once secured, the cords 48 of the two tensioning devices 44 are extended to a body part of the person training, such as the shoe 84 worn on the person's feet. Next, the cords 48 of the two tensioning devices 44 are secured to the body part of the person training and the tensioning devices are locked by sliding the button 64 to maintain the cord 48 in the extended position. Once fitted, the person training can perform an anaerobic activity, such as running or exercising, or any other desired activity.

Figure 12:
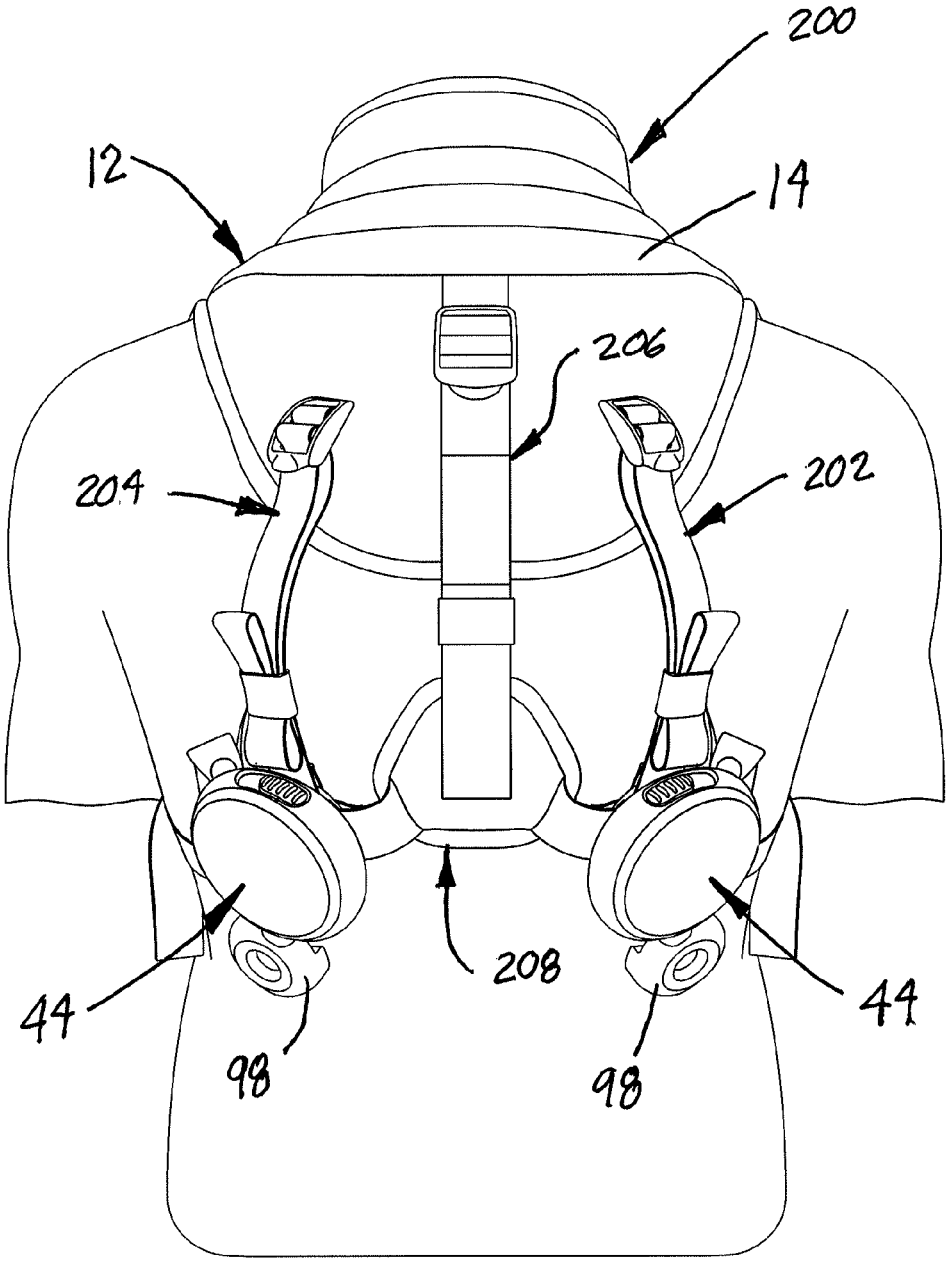
FIG. 12 is a back view of an adjustable training apparatus of another embodiment having tensioning devices located at a back of the person training.

Referring to FIG. 12, an adjustable training is generally indicated at 200. As shown, the adjustable training apparatus 200 is similar to the adjustable training apparatus 10, except the tensioning devices 44 are located at the back of the person training, not the front. The adjustable training apparatus 200 includes a harness 12 that is worn over an upper torso of a person training with the adjustable training apparatus. The harness 12 includes a strip of material 14 that is configured to be worn over shoulders and around the neck of the person training. The harness 12 further includes three vertical strap assemblies, generally indicated at 202, 204 and 206, and a horizontal strap assembly, generally indicated at 208, which are configured similarly to vertical strap assemblies 24, 26 and 28 and horizontal strap assembly 30, except all three vertical strap assemblies 202, 204, 206 are located on the back of the person training. As shown, the adjustable training apparatus 200 further includes two tensioning devices 44 that are secured to the harness 12. Each tensioning device 44 is releasably secured to the harness 12 and a cord 48 that extends from and retracts back into the housing. As shown, the cord 48 of each tensioning device 44 has an outer end that configured to be secured to a connector, such as connector 98. The adjustable training apparatus 200 is particularly suited for use during skating.

Also, the phraseology and terminology used herein is for the purpose of description and should not be regarded as limiting. Any references to embodiments or elements or acts of the systems and methods herein referred to in the singular may also embrace embodiments including a plurality of these elements, and any references in plural to any embodiment or element or act herein may also embrace embodiments including only a single element. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation.

Having thus described several aspects of at least one embodiment, it is to be appreciated various alterations, modifications, and improvements will readily occur to those skilled in the art. Such alterations, modifications, and improvements are intended to be part of this disclosure and are intended to be within the scope of the disclosure. Accordingly, the foregoing description and drawings are by way of example only, and the scope of the disclosure should be determined from proper construction of the appended claims, and their equivalents.

What is claimed is:

1. An adjustable training apparatus comprising:

a harness that is worn over an upper torso of a person training; and two tensioning devices that are secured to the harness, each tensioning device including a cord that extends from the device, with an outer end of the cord being configured to be secured to a body part of the person training, wherein the harness includes a first vertical strap, a second vertical strap, a horizontal strap secured to the first vertical strap and the second vertical strap, a first tensioning device of the two tensioning devices releasable secured to the first vertical strap and the horizontal strap by a first disc, and a second tensioning device of the two tensioning devices releasably secured to the second vertical strap and the horizontal strap by a second disc, each tensioning device including a connection assembly configured to releasably secure the outer end of the cord to the body part of the person training, the connection assembly including a foot harness having a body portion and a strap having hook and loop fastener material that is secured to the body portion, the strap of the foot harness being configured to secure the body portion to the body part of the person training.

2. The adjustable training apparatus of claim 1, wherein the harness further includes a strip of material configured to be worn over shoulders of the person training, the first vertical strap and the second vertical strap being coupled to the strip of material and configured to be cinched on the torso of the person training.

3. The adjustable training apparatus of claim 2, wherein the harness further includes a collar portion integrally formed with the strip of material, the collar portion being configured to engage a neck of the person training.

4. The adjustable training apparatus of claim 3, wherein the harness further includes a first shoulder portion that extends down from the collar portion on one shoulder of the person training and a second shoulder portion that extends down from the collar portion on another shoulder of the person training.

5. The adjustable training apparatus of claim 4, wherein the harness further includes a third vertical strap that extends down from the collar portion of the strip of material.

6. The adjustable training apparatus of claim 5, wherein the horizontal strap is secured to the third vertical strap, the horizontal strap extending crosswise with respect to the first vertical strap, the second vertical strap, and the third vertical strap.

7. The adjustable training apparatus of claim 1, wherein the tensioning devices may be interchanged to increase or decrease a tension of the cord associated With each tensioning device.

8. The adjustable training apparatus of claim 1, wherein the connection assembly further includes a first connector secured to the outer end of the cord and a second connector secured to the foot harness, the first connector and the second connector being releasably coupled to one another.

9. The adjustable training apparatus of claim 8, wherein the first connector includes a female element and the second connector includes a male element.

10. The adjustable training apparatus of claim 1, wherein the strap of the foot harness is configured to be secured to a running shoe.

11. The adjustable training apparatus of claim 1, wherein the cords of the tensioning devices extend along respective sides of the person training when wearing the adjustable training apparatus.

12. The adjustable training apparatus of claim 1, wherein each tensioning device includes a housing, a retractable spool assembly having the cord that extends from and retracts into the housing, and a brake to releasably clamp the cord at a desired length.

13. An adjustable training apparatus comprising:

a harness that is worn over an upper torso of a person training; and two tensioning devices that are secured to the harness, each tensioning device including a cord that extends from the device, with an outer end of the cord being configured to be secured to a body part of the person training, wherein each tensioning device includes a generally circular body and a wheel slidably movable in the body between a first position in which the wheel is free to rotate and a second position in which the wheel is locked to maintain the cord wrapped around the wheel in a locked position.

14. A method of conducting anaerobic resistance training, the method comprising:

securing a harness to an upper torso of a person training;

extending cords of two tensioning devices that are secured to the harness to a body part of the person training;

securing the cords of the two tensioning devices to the body part of the person training; and performing an anaerobic activity, wherein the harness includes a first vertical strap, a second vertical strap, a horizontal strap secured to the first vertical strap and the second vertical strap, a first tensioning device of the two tensioning devices releasably secured to the first vertical strap and the horizontal strap by a first disc, and a second tensioning device of the two tensioning devices releasably secured to the second vertical strap and the horizontal strap by a second disc, and wherein each tensioning device includes a generally circular body and a wheel slidably movable in the body between a first position in which the wheel is free to rotate and a second position in which the wheel is locked to maintain the cord wrapped around the wheel in a locked position.

15. The method of claim 14, wherein the cords of the two tensioning devices extend along respective sides of the person training when wearing the adjustable training apparatus.

16. The method of claim 14, wherein securing the harness to the upper torso of the person training includes placing a strip of material of the harness about the neck and shoulders of the person training and cinching strap assemblies of the harness.

17. The method of claim 14, wherein securing the cords of the two tensioning devices to the body part of the person training is achieved, for each tensioning device, by a connection assembly including a first connector secured to an end of the cord and a second connector secured to the body part of the person training, the first connector and the second connector being releasable coupled to one another.

* * * * *